US010272983B2

(12) United States Patent
Smith

(10) Patent No.: US 10,272,983 B2
(45) Date of Patent: Apr. 30, 2019

(54) BOAT HEAT EXCHANGER SYSTEM AND METHOD

(71) Applicant: Strom W. Smith, Ocean Springs, MS (US)

(72) Inventor: Strom W. Smith, Ocean Springs, MS (US)

( * ) Notice: Subject to any disclaimer, the term of this patent is extended or adjusted under 35 U.S.C. 154(b) by 0 days.

(21) Appl. No.: 16/142,656

(22) Filed: Sep. 26, 2018

(65) Prior Publication Data

US 2019/0092442 A1 Mar. 28, 2019

Related U.S. Application Data

(60) Provisional application No. 62/564,886, filed on Sep. 28, 2017.

(51) Int. Cl.
*B63H 21/38* (2006.01)
*F01P 3/20* (2006.01)

(52) U.S. Cl.
CPC ..... *B63H 21/383* (2013.01); *F01P 3/207* (2013.01)

(58) Field of Classification Search
CPC .. B63H 21/10; B63H 21/38; F01P 9/00; F01P 3/20; F28F 9/06; F28F 21/06
USPC ..... 440/88 M, 88 HE
See application file for complete search history.

(56) References Cited

U.S. PATENT DOCUMENTS 3,452,702 A * 7/1969 Slemmons ..... B60F 3/0007 180/22
3,650,310 A * 3/1972 Childress ..... B63B 39/061 440/88 HE
3,841,396 A * 10/1974 Knaebel ..... B63H 21/10 165/168
5,004,042 A * 4/1991 McMorries, IV ..... F01P 3/207 440/88 HE
5,337,774 A * 8/1994 Boyd ..... B63H 20/36 440/88 M
5,599,217 A * 2/1997 Ferrante ..... F01P 3/207 440/88 HE
5,746,270 A * 5/1998 Schroeder ..... B63H 21/10 440/88 HE
5,931,217 A * 8/1999 Fernstrum ..... F28D 1/022 440/88 HE
7,114,469 B1 * 10/2006 Taylor ..... B63H 21/00 440/88 C
7,128,025 B1 * 10/2006 Westhoff, Jr. ..... F01P 3/202 123/41.01
7,264,520 B1 * 9/2007 Taylor ..... F01P 11/08 440/88 HE

* cited by examiner

*Primary Examiner* — Lars A Olson
(74) *Attorney, Agent, or Firm* — Keeling Law, LLC; Kenneth A. Keeling; Mark S. Solomon

(57) ABSTRACT

Embodiments of a boat heat exchanger system of the present invention employable to cool a user device via heat transfer generally include an inlet pipe, an outlet pipe, and an inline pump, wherein the inlet pipe is fluidly connectable to an external aqueous fluid source. In one embodiment, a closed-looped system utilizing a heat exchange component of a contained external aqueous fluid source is provided. In another aspect, embodiments of a boat heat exchanger system of the present invention contain a close-looped system and generally include an inlet pipe, an outlet pipe, an inline pump, and an externally disposed heat exchanger, wherein an aqueous fluid is recirculated through the heat exchanger system. Methods of cooling user devices on a boat using embodiments of a boat heat exchanger system are provided.

13 Claims, 3 Drawing Sheets

BOAT HEAT EXCHANGER SYSTEM AND METHOD

CROSS-REFERENCE TO RELATED APPLICATIONS

This application claims the benefit of U.S. Provisional Application No. 62/564,886 filed on Sep. 28, 2017, which application is incorporated herein by reference as if reproduced in full below.

STATEMENT REGARDING FEDERALLY SPONSORED RESEARCH OR DEVELOPMENT

Not Applicable.

BACKGROUND OF THE INVENTION

Many boats utilize one or more on-board devices which require cooling. Herein, the term "boat" is used to mean any type of vessel, including but not limited to, a boat, ship, yacht, barge, etc. used to navigate a body of water. Typically, such devices are cooled by circulating an aqueous fluid (e.g., water) through a heat exchanger system, whereby the heat from the device is transferred to the circulating cooling water, thereby keeping the device cooled. In many applications, the water utilized and circulated in the heat exchanger system comprises water obtained from the body of water in which the boat is situated. While the body of water generally possesses sufficient water for this process, the quality of the water may be undesirable. For example, the water may contain living organisms (such as algae, bacteria, etc.) which tend to thrive within the heat exchanger system and can cause pluggage or otherwise foul the heat exchanger system. In addition, the body of water may contain other objects, such as debris, pollutants, mud, silt, garbage, etc., which may cause pluggage or other problems with the heat exchanger system. Such pluggage or other problems associated with boat heat exchanger water quality lead to maintenance costs and downtime which is undesirable.

A need therefore exists for a boat heat exchanger system which utilizes better quality water in its heat exchanger system. As different boats in different situations may desire to utilize either a self-contained higher quality water source, and/or an accessible remotely located higher quality water source, it is desirable that such a system provides the flexibility to allow for one or both of such different sources of higher quality water.

BRIEF SUMMARY OF THE INVENTION

Embodiments of a boat heat exchanger system of the present invention generally include an inlet pipe, an outlet pipe, and an inline pump, wherein the inlet pipe is fluidly connectable to a contained external aqueous fluid source. In another aspect, embodiments of a boat heat exchanger system of the present invention comprise a close-looped system and generally include an inlet pipe, an outlet pipe, an inline pump, and an externally disposed heat exchanger, wherein an aqueous fluid is recirculated through the heat exchanger system.

BRIEF DESCRIPTION OF THE DRAWINGS

For a more complete understanding of the present invention, reference is now made to the accompanying drawings, in which.

DETAILED DESCRIPTION OF EXEMPLARY EMBODIMENTS OF THE INVENTION

Figure 1:
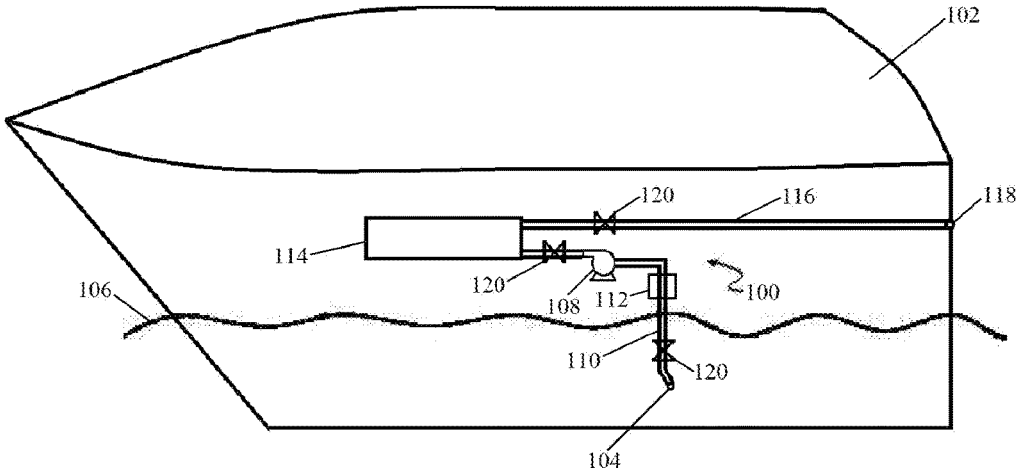
Figure 1 (Prior Art)
FIG. 1 a depiction of a prior art boat heat exchanger system.

The exemplary embodiments are best understood by referring to the drawings, like numerals being used for like and corresponding parts of the various drawings. In the following description of embodiments, orientation indicators such as "top," "bottom," "up,' "down," "upper," "lower," "front," "back," etc. are used for illustration purposes only; the invention, however, is not so limited, and other possible orientations are contemplated.

Referring first to FIG. 1, a prior art boat heat exchanger system 100 as previously known within the art is depicted. Heat exchanger system 100 is contained substantially within the interior of boat 102. Heat exchanger system 100 includes an inlet opening 104 disposed below the waterline 106. Utilizing a pump 108, water from the exterior of the boat 102 is drawn through inlet opening 104 into inlet piping 110. A purification device, such as a strainer, 112 may be installed in inlet piping 110. Water within inlet piping 110 is pumped to one or more user devices 114 comprising a heat exchange component (not shown) for cooling purposes. Spent cooling water flows from the user devices 114 through outlet piping 116 and is discharged, via an outlet opening 118, back in the body of water in which the boat is situated. In the embodiment shown in FIG. 1, outlet opening 118 is disposed above the waterline 106, although other arrangements are possible. A heat exchanger system 100 may comprise one or more valves 120 in inlet piping 110 and/or outlet piping 116 to control flow through heat exchanger system 100 as would be understood by one skilled in the art.

Figure 2:
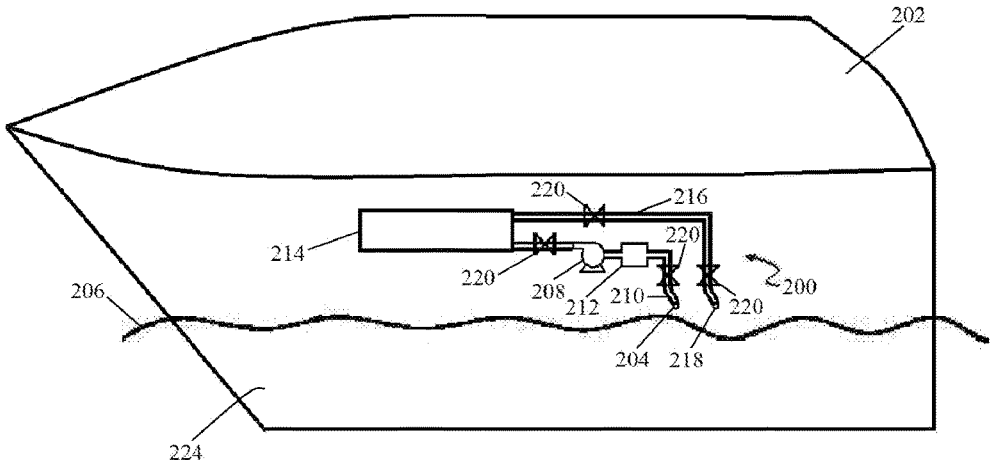
FIG. 2 is a depiction of an embodiment of a boat heat exchanger system of the present invention.

Referring now to FIG. 2, an embodiment of a heat exchanger system 200 of the present invention is depicted. Heat exchanger system 200 is contained substantially within the interior of boat 202. Heat exchanger system 200 includes an inlet opening 204. In one embodiment, inlet opening 204 is disposed above the waterline 206, although other arrangements are possible. In one embodiment, inlet opening 204 is at least partially disposed within or exterior to a hull 224 of boat 202.

In one embodiment, inlet opening 204 is fluidly connectable to a water source (not shown). Herein, the term "water source" is used to mean a contained source of any aqueous based fluid, such as, but not limited to, water, antifreeze, alcohol, and combinations thereof, and "water" from a water source means such fluids obtained from the water source. In one aspect, the water source (not shown) may be disposed on or at least partially within boat 202. In one aspect, the water source (not shown) may be disposed on a dock. Herein, the term "dock" is used to mean any onshore structure, such as, but not limited to, a dock, pier, wharf, quay, etc., used to moor a boat, or a non-land based structure, such as an offshore structure fixed to the floor of a body of water, a floating platform, or another floating vessel, used to moor a boat.

In one embodiment, utilizing one or more pumps 208, water from the water source (not shown) is drawn through inlet opening 204 into inlet piping 210. In one embodiment, inlet opening 204 is at least partially disposed within or exterior to a hull 224 of boat 202. One or more fluid purification devices, such as a strainer, 212 may be installed in inlet piping 210. Inlet piping 210 is fluidly connected to one or more user devices 214 comprising a heat exchange component (not shown). Herein, the term "heat exchange component" is used to mean a component of a device used to transfer heat between two or more fluids. In one aspect, a user device 214 may be, or be a component of, a device such as, but not limited to, an engine, an air conditioning (A/C) system, or a refrigeration system. In one embodiment, a user device 214 may comprise an inboard engine or an outboard engine. Water within inlet piping 210 is pumped to the one or more user devices 214 for cooling purposes. In one embodiment, spent cooling water flows from the user device(s) 214 through outlet piping 216, which is fluidly connected to the user devices 214, and is discharged out an outlet opening 218. In the embodiment shown in FIG. 2, outlet opening 218 is disposed above the waterline 206, although other arrangements are possible. In one embodiment, outlet opening 218 is at least partially disposed within or exterior to a hull 224 of boat 202. A heat exchanger system 200 may comprise one or more valves 220 in inlet piping 210 and/or outlet piping 216 to control flow through heat exchanger system 200 as would be understood by one skilled in the art.

In one embodiment, the water source (not shown) comprises a heat exchange component (not shown). In one embodiment, the water source heat exchange component (not shown) is positioned proximate a dock (not shown) and is at least partially disposed beneath the waterline 206. In one embodiment, the water source heat exchange component (not shown) comprises a plate-fin heat exchanger, although other types of heat exchangers, such as, but not limited to, shell and tube, plate, plate and shell, may be employed, as would be understood by one skilled in the art.

In one embodiment, the heat exchanger system 200 is fluidly connectable to the water source (not shown) via portable fluid conduits, such as, but not limited to, flex hoses. In one embodiment, inlet opening 204 is fluidly connected to the water source (not shown). In one embodiment, outlet opening 218 is fluidly connected to the water source (not shown).

Figure 3:
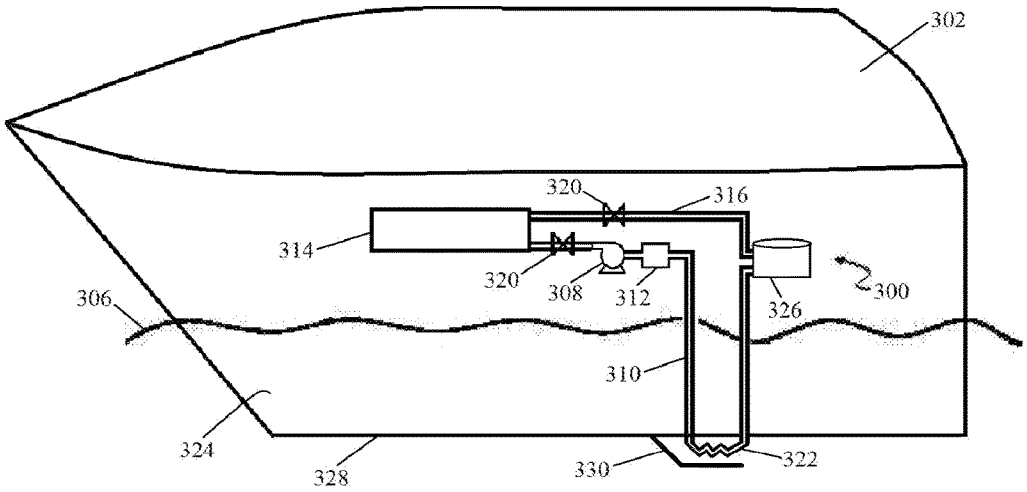
FIG. 3 is a depiction of another embodiment of a boat heat exchanger system of the present invention.

Another embodiment of the present invention is shown in FIG. 3. Therein is depicted a heat exchanger system 300 of the present invention. In the embodiment of FIG. 3, heat exchanger system 300 is disposed partially within a boat 302 and partially exterior thereto. In one embodiment heat exchanger system 300 comprises inlet piping 310 fluidly connected to a pump 308. A fluid purification device, such as a strainer, 312 may be installed in inlet piping 310. In one embodiment, inlet piping 310 is fluidly connected to one or more user devices 314 comprising a heat exchange component (not shown). In one aspect, a user device 314 may be, or be a component of, a device such as, but not limited to, an engine, an air conditioning (A/C) system, or a refrigeration system. In one embodiment, a user device 314 may comprise an inboard engine or an outboard engine. In one embodiment, heat exchanger system 300 comprises outlet piping 316 which is fluidly connected to one or more user devices 314. In one embodiment, heat exchanger system 300 comprises a fluid reservoir, i.e., a surge tank, 326 fluidly connected to inlet piping 310 and/or outlet piping 316. A heat exchanger system 300 may comprise one or more valves 320 in inlet piping 310 and/or outlet piping 316 to control flow through heat exchanger system 300 as would be understood by one skilled in the art.

In one embodiment, outlet piping 316 is fluidly connected to a heat exchange component 322 which is disposed at least partially outside of boat 302. In one embodiment, inlet piping 310 is fluidly connected to heat exchange component 322. In one embodiment, the fluid connection of heat exchange component 322 to inlet piping 310 and/or outlet piping 316 comprises penetration through the hull 324 of boat 302.

In one embodiment, heat exchange component 322 comprises a component of a plate-fin heat exchanger, although other types of heat exchangers, such as, but not limited to, shell and tube, plate, plate and shell, may be employed, as would be understood by one skilled in the art. In one embodiment, heat exchange component 322 is disposed beneath the bottom 328 of boat 302, although other configurations are contemplated. In one embodiment, a deflecting device 330 is employed to protect heat exchange component 322 from damaging impact with objects in the body of water. In one embodiment, a deflecting device may comprise one or more orifices (not shown) there through to allow water in the body of water to flow more directly into contact with heat exchange component 322. In one embodiment, deflecting device 330 is removably attached to hull 324, although other arrangements may be employed.

In one embodiment, water from a water source, i.e., water, antifreeze, alcohol, a combination thereof, etc., is provided within heat exchanger system 300. This water is drawn from heat exchange component 322 into inlet piping 310 utilizing pump 308. The water within inlet piping 310 is provided to the user device(s) 314 for cooling purposes. In one embodiment, spent cooling water flows from the user device(s) 314 through outlet piping 316 back into heat exchange component 322, either directly or via surge tank 326. The water cooled by the heat exchange component 322 is then available for recirculation within heat exchanger system 300.

While the embodiments of boat heat exchanger systems 200 and 300 are depicted as distinct configurations, the invention is not so limited and a boat may comprise heat exchange systems incorporating the components and piping arrangements of both heat exchanger system 200 and heat exchanger system 300. In addition, heat exchanger system 200 and/or heat exchanger system 300 may be used in conjunction with a prior art heat exchanger system 100.

Operation

In operation, a boat heat exchanger system 200 may be used to provide cooling utilizing water from a water source. In one embodiment, a boat 202 is positioned proximate a dock (not shown). In one embodiment, inlet opening 204 is fluidly connected to a fluid outlet of a water source (not shown) not aboard boat 204. In one embodiment, outlet opening 218 is attached to a fluid inlet of the water source (not shown). In other embodiments (not shown), outlet opening 218 may be attached to an apparatus other than the water source, or may be left unconnected whereby water discharged there through flows into the body of water in which the boat 202 is situated or flows openly otherwise onto the dock and/or open conduits/vessels thereon.

As mentioned above, a boat heat exchanger system 200 may be utilized on conjunction with a prior art boat heat exchanger system 100. Additionally, a boat heat exchanger system 200 may be operated similarly to a boat heat exchanger system 100. In one such embodiment (not shown), wherein inlet opening 204 is in fluid communication with the body of water in which the boat 202 is situated, (e.g., inlet opening 204 is disposed beneath waterline 206), water from that body of water may be utilized as cooling water in the operation of boat heat exchanger system 200. In one embodiment, any residual cooling water remaining within boat heat exchanger system 200 before it is fluidly connected to the water source may be "flushed" from boat heat exchanger system 200 prior to such connection being made.

In one embodiment, pump 208 is used to draw cooling water from the water source into heat exchanger system 200. In other embodiments (not shown), an exteriorly disposed fluid flow generation system, such as, but not limited to, a dock-side pump, is utilized along with, or in lieu of, pump 208 to provide fluid flow within heat exchanger system 200. In one embodiment (not shown), when pump 208 is not utilized for water circulation, other configurations of inlet piping 210 (not shown) may be utilized to bypass pump 208. In one embodiment, pump 208 draws cooling water from the water source into inlet piping 210 via inlet opening 204. In this embodiment, water optionally flows through one or more strainers 212 and is pumped into heat transfer engagement with one or more user devices 214, as would be understood by one skilled in the art. In one embodiment, water flows beyond heat transfer engagement with the one or more user devices 214; i.e., is transformed into "spent" cooling water, and then flows through outlet piping 216 to outlet opening 218. As described above, water flowed out of outlet opening 218 may be fluidly communicated back to the water source, or otherwise discharged from heat exchanger system 200.

In various embodiments, one or more valves 220 may be employed to allow, prevent, and/or control flow of water through heat exchanger system 200, as would be understood by one skilled in the art. While the embodiment depicted in FIG. 2 shows a particular number and arrangement of pumps 208, valves 220, and strainers 212, other embodiments employing different numbers and arrangements thereof may be utilized in a heat exchanger system 200.

In one embodiment, the water source (not shown) comprises a heat exchange component (not shown). In one embodiment, the water source heat exchange component (not shown) is positioned proximate a dock (not shown) and is at least partially disposed beneath the waterline 206. In one embodiment, utilizing a heat exchanger system 200 in conjunction with a water source comprising a heat exchange component comprises the operations described above, but spent cooling water exiting heat exchanger system 200 via outlet opening 218 is communicated back to the heat exchange component water source wherein the water is fluidly communicated into heat transfer engagement with the water source heat exchange component, whereby the water is cooled and can be fluidly communicated back into heat exchanger system 200 via inlet opening 204. In one aspect, this provides a "closed loop" system wherein cooling water from the water source is circulated through heat exchanger system 200, transforming from cooling water to spent water, circulated back through the water source heat exchange component, transforming from spent water back to cooling water, and then re-circulated back through heat exchanger system 200 in a continuous process.

In operation, a boat heat exchanger system 300 may be used to provide cooling utilizing water from a water source. In one embodiment, water from a water source, i.e., water, antifreeze, alcohol, a combination thereof, etc., is provided within heat exchanger system 300. In one embodiment such water is provided utilizing an optional surge tank 326. In one embodiment, pump 308 is operated to circulate the water through the heat exchanger system 300. In this embodiment, cooling water is drawn from heat exchange component 322 into inlet piping 310. In one embodiment the cooling water is flowed through one or more strainers 312. The cooling water within inlet piping 310 is then flowed into heat transfer engagement with one or more user devices 314. In one embodiment, spent cooling water flows from the user device(s) 314 through outlet piping 316 to heat exchange component 322. In the embodiment depicted in FIG. 3, the spent cooling water flows through surge tank 326, or bypasses optional surge tank 326 via additional piping (not shown) before entering heat exchange component 322. The spent cooling water is cooled by heat exchange component 322, and is then reintroduced into inlet piping 310 to be reutilized for cooling within heat exchanger system 300. Accordingly, heat exchanger system 300 comprises a substantially closed loop system utilizing a continuous cooling process.

In various embodiments, one or more valves 320 may be employed to allow, prevent, and/or control flow of water through heat exchanger system 300, as would be understood by one skilled in the art. While the embodiment depicted in FIG. 3 shows a particular number and arrangement of pumps 308, valves 320, strainers 312, and surge tanks 326, other embodiments employing different numbers and arrangements thereof may be utilized in a heat exchanger system 300.

Method

An exemplary cooling method utilizing an embodiment of a boat heat exchanger system of the present invention comprises:

A Heat Exchanger System Provision Step, comprising providing a heat exchanger system, such as heat exchanger system 200, installed on a boat, the heat exchanger system comprising an inlet opening, such as inlet opening 204; inlet piping, such as inlet piping 210, fluidly connected to the inlet opening; a pump, such as pump 208, fluidly connected to the inlet piping; outlet piping, such as outlet piping 216, and an outlet opening, such as outlet opening 218, fluidly connected to the outlet piping; wherein the inlet piping and outlet piping are in heat transfer communication with one or more user devices, such as user device 214;

A Heat Exchanger System Connection Step, comprising fluidly connecting the inlet opening to a contained cooling water source disposed external to the boat and optionally fluidly connecting the outlet opening to the cooling water source; and A Heat Exchanger System Operation Step, comprising operating the pump to draw cooling water from the cooling water source into the inlet piping via the inlet opening, whereby the cooling water is flowed into heat transfer engagement with at least one of the one or more user devices, and whereby the spent cooling water flows out of the user devices into the outlet piping and is discharged from the heat exchanger system via the outlet opening.

In various embodiments the method utilizes a heat exchanger system comprising one or more strainers, such as strainers 212, and/or one or more valves, such as valves 220. In other embodiments of the method, a pump external to the boat is utilized with or in lieu of the pump of the heat exchange system to flow water there through.

In other embodiments of the method, the cooling water source comprises a heat exchange component fluidly connected to the heat exchanger system, via the inlet opening and the outlet opening, wherein water is recirculated through the heat exchanger system and the water source heat exchange component.

Another exemplary cooling method utilizing an embodiment of a boat heat exchanger system of the present invention comprises:

A Heat Exchanger System Provision Step, comprising providing a heat exchanger system, such as heat exchanger system 300, installed on a boat, the heat exchanger system comprising inlet piping, such as inlet piping 310; a pump, such as pump 308, fluidly connected to the inlet piping; outlet piping, such as outlet piping 316; and a heat exchange component, such as heat exchange component 332; wherein the heat exchange component is in fluid communication with the inlet piping and the outlet piping; and wherein the inlet piping and outlet piping are in heat transfer communication with one or more user devices, such as user device 314;

A Cooling Liquid Provision Step, comprising providing cooling liquid, such as water, to the heat exchanger system; and A Heat Exchanger System Operation Step, comprising operating the pump to draw cooling water from the heat exchange component into the inlet piping, whereby the cooling water is flowed into heat transfer engagement with at least one of the one or more user devices, and whereby the spent cooling water flows out of the user devices into the outlet piping and is flowed back to the heat exchange component, wherein the spent cooling water is cooled.

In various embodiments the method utilizes a heat exchanger system comprising one or more strainers, such as strainers 312, and/or one or more valves, such as valves 320. In other embodiments of the method, the heat exchange system comprises one or more surge tanks, such as surge tanks 326.

The foregoing methods are merely exemplary, and additional embodiments of cooling methods of utilizing a boat heat exchanger system of the present invention consistent with the teachings herein may be employed. In addition, in other embodiments, one or more of these steps may be performed concurrently, combined, repeated, re-ordered, or deleted, and/or additional steps may be added.

The foregoing description of the invention illustrates exemplary embodiments thereof. Various changes may be made in the details of the illustrated construction and process within the scope of the appended claims by one skilled in the art without departing from the teachings of the invention. The present invention should only be limited by the claims and their equivalents.

I claim:

1. A heat exchanger system comprising:

an inlet opening;

inlet piping;

an outlet opening; and outlet piping;

wherein:

said heat exchanger system is disposed substantially on a boat;

said inlet opening is fluidly connected to said inlet piping, and said inlet piping penetrates a hull of said boat;

said outlet opening is fluidly connected to said outlet piping, and said outlet piping penetrates said hull of said boat;

said inlet opening is fluidly connectable to an aqueous fluid source that is not disposed on said boat;

said aqueous fluid source does not comprise a body of water in which said boat is situated;

at least a portion of said heat exchanger system is in heat transfer engagement with one or more user devices; and aqueous fluid from said aqueous fluid source introduced into said heat exchanger system via said inlet piping flows into heat transfer engagement with at least one of said one or more user devices, and wherein subsequent to said heat transfer engagement, at least a portion of said aqueous fluid flows through said outlet piping and is thereby discharged out of said heat exchanger system via said outlet opening.

2. The heat exchanger system of claim 1, wherein at least one pump is utilized to introduce said aqueous fluid from said aqueous fluid source into said heat exchanger system.

3. The heat exchanger system of claim 2, wherein at least one said pump is disposed on said boat.

4. The heat exchanger system of claim 2, wherein at least one said pump is disposed exterior to said boat.

5. The heat exchanger system of claim 4, wherein at least one said pump is disposed on or proximate a dock.

6. The heat exchanger system of claim 5, wherein at least one said pump disposed on or proximate said dock is fluidly connected to said inlet piping or said outlet piping.

7. The heat exchanger system of claim 1, wherein said aqueous fluid source is disposed on or proximate said dock.

8. A method of cooling user devices on a boat comprising:

providing the heat exchanger system of claim 1;

connecting said inlet opening to said aqueous fluid source;

introducing said aqueous fluid into said inlet piping, whereby said aqueous fluid is flowed into heat transfer engagement with at least one of said one or more user devices, and whereby said aqueous fluid, subsequent to said heat transfer engagement, is flowed through said outlet piping and is discharged from said heat exchanger system via said outlet opening.

9. The method of claim 8, wherein said introducing said aqueous fluid into said inlet piping comprises utilization of at least one pump.

10. The method of claim 9, wherein at least one said pump is disposed on said boat.

11. The method of claim 9, wherein at least one said pump is disposed exterior to said boat.

12. The heat exchanger system of claim 11, wherein at least one said pump disposed exterior to said boat is disposed on or proximate a dock.

13. The method of claim 8, wherein said aqueous fluid source is disposed on or proximate said dock.

* * * * *